US006761429B2

(12) United States Patent
Su et al.

(10) Patent No.: US 6,761,429 B2
(45) Date of Patent: Jul. 13, 2004

(54) BULLDOZING CLEANER FOR INKJET ELECTROSTATIC DROP DETECTORS

(75) Inventors: Wen-Li Su, Vancouver, WA (US); Patrick Therien, Battle Ground, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/264,515

(22) Filed: Oct. 4, 2002

(65) Prior Publication Data

US 2003/0030691 A1 Feb. 13, 2003

Related U.S. Application Data

(63) Continuation of application No. 09/773,408, filed on Jan. 31, 2001, now Pat. No. 6,533,377.

(51) Int. Cl.[7] ..... B41J 2/165

(52) U.S. Cl. ..... 347/33; 347/1; 347/81

(58) Field of Search ..... 347/1, 22, 33, 347/6, 24, 29, 31, 32, 34, 35, 36, 81; 346/25; 15/250, 361

(56) References Cited

U.S. PATENT DOCUMENTS 5,815,176 A * 9/1998 Rotering ..... 347/33
6,533,377 B2 * 3/2003 Su et al. ..... 347/1

* cited by examiner

*Primary Examiner*—Shih-wen Hsieh

(57) ABSTRACT

A bulldozer-type cleaning system is provided for removing ink residue from an electrostatic drop detecting sensor which detects ink droplets contacting the detector. A scraper head scrapes the ink residue from the sensor, and then contacts a flexible, compliant cleaning member, illustrated as a coil spring. The spring is secured at each end and is stretched when pushed by the scraper head. This stretching flexation allows the spring to trap the ink residue between the coils. As the scraper head retracts, the resulting contracting flexation of the spring squeezes the ink residue from between the coils. Any ink residue remaining on the coils dries and then flakes off the coils when the spring is stretched again during the next cleaning stroke of the scraper head. An inkjet printing mechanism having such a cleaning system, and a method of cleaning a sensor are also provided.

27 Claims, 6 Drawing Sheets

BULLDOZING CLEANER FOR INKJET ELECTROSTATIC DROP DETECTORS

CROSS REFERENCE TO RELATED APPLICATION

This is a continuation of application Ser. No. 09/773,408 filed on Jan. 31, 2001 now U.S. Pat. No. 6,533,377, which is hereby incorporated by reference herein.

INTRODUCTION

The present invention relates generally to inkjet printing mechanisms, and more particularly to a bulldozer-type cleaner for removing ink residue from an electrostatic drop detector which detects ink droplets contacting the detector.

Inkjet printing mechanisms use pens which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which hermetically seals the printhead nozzles from contaminants and drying. To facilitate priming, some printers have priming caps that are connected to a pumping unit to draw a vacuum on the printhead. During operation, partial occlusions or clogs in the printhead are periodically cleared by firing a number of drops of ink through each of the nozzles in a clearing or purging process known as "spitting." The waste ink is collected at a spitting reservoir portion of the service station, known as a "spittoon." After spitting, uncapping, or occasionally during printing, most service stations have a flexible wiper, or a more rigid spring-loaded wiper, that wipes the printhead surface to remove ink residue, as well as any paper dust or other debris that has collected on the printhead.

To improve the clarity and contrast of the printed image, recent research has focused on improving the ink itself. To provide quicker, more waterfast printing with darker blacks and more vivid colors, pigment based inks have been developed. These pigment based inks have a higher solids content than the earlier dye-based inks, which results in a higher optical density for the new inks. Both types of ink dry quickly, which allows inkjet printing mechanisms to use plain paper.

Unfortunately, occasionally a printhead nozzle becomes permanently damaged or blocked, so the nozzle is no longer able to eject ink. A missing nozzle cannot eject ink when directed to do so by the printer controller, leaving bare spots in the resulting image. Most earlier inkjet printers had no way of knowing when a nozzle was missing from the array, and the only way to improve print quality was to replace the defective printhead, often while the pen still contained a good supply of ink. Thus, there was a need to know when a particular nozzle was no longer functioning, and to fill this need a low cost ink drop detector was invented, as described in U.S. Pat. No. 6,086,190 to Schantz et al., currently assigned to the present assignee, the Hewlett-Packard Company. Use of the electrostatic drop detector provides a mechanism for communicating to the printer controller when a particular nozzle is out. Knowing this information, the printer controller may substitute a nozzle which is in good working order for the bad nozzle so print quality is unaffected by the missing nozzle. There are a variety of different ways this may be done, for instance using multi-pass print modes various shingling or mask routines, or other schemes known to those skilled in the art.

While several different types of electrostatic drop detectors are discussed in the Schantz et al. patent, several of the illustrated embodiments use an ink absorbing pad, such as a foam material, in conjunction with the electrostatic drop detector. The purpose of this foam is to absorb liquid components of the ink being spit onto the detector. However, as mentioned above, the current preferred electrostatic drop detector has a relatively smooth spit target surface, with no ability to absorb liquid components of the ink, or to dispel particulate matter of the ink composition. Indeed, droplets which are fired from functioning nozzles onto the drop detector may eventually build up over time, causing the detector to give inaccurate readings. In an extreme case, the ink residue may actually build up and form stalagmites. These ink stalagmites may eventually grow to a height where they could hit and damage the printhead, clogging nozzles or permanently destroying the printhead. Thus, it is apparent that an inkjet printing mechanism using such an electrostatic drop detection system needs some manner of addressing the ink residue build-up on the detector.

DRAWING FIGURES

FIGS. 3 and 4 are enlarged, side elevational views of the service station of FIG. 1, with the bulldozing cleaner system of:

Figure 3:
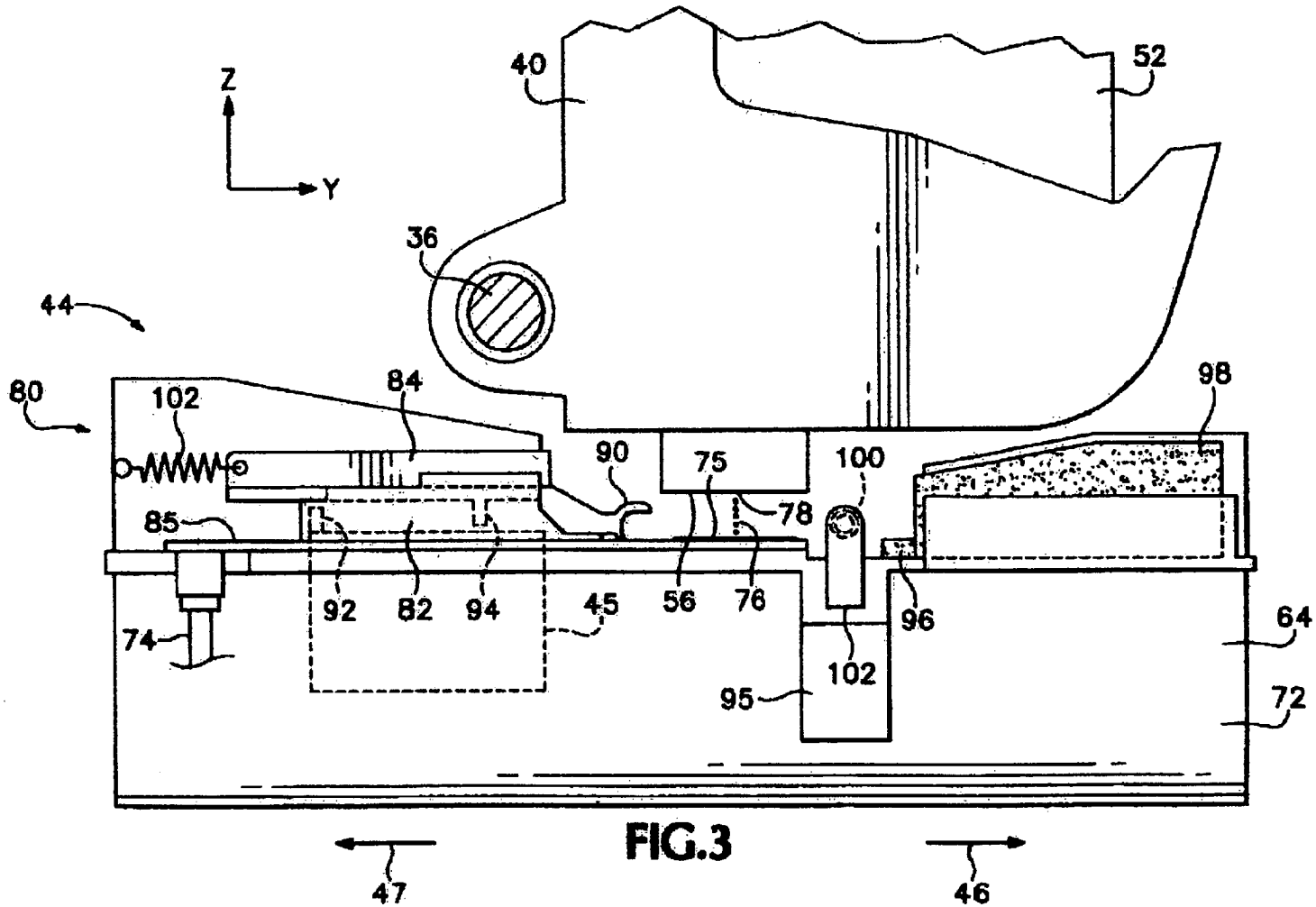

FIG. 3 showing a retracted rest position; and

Figure 4:
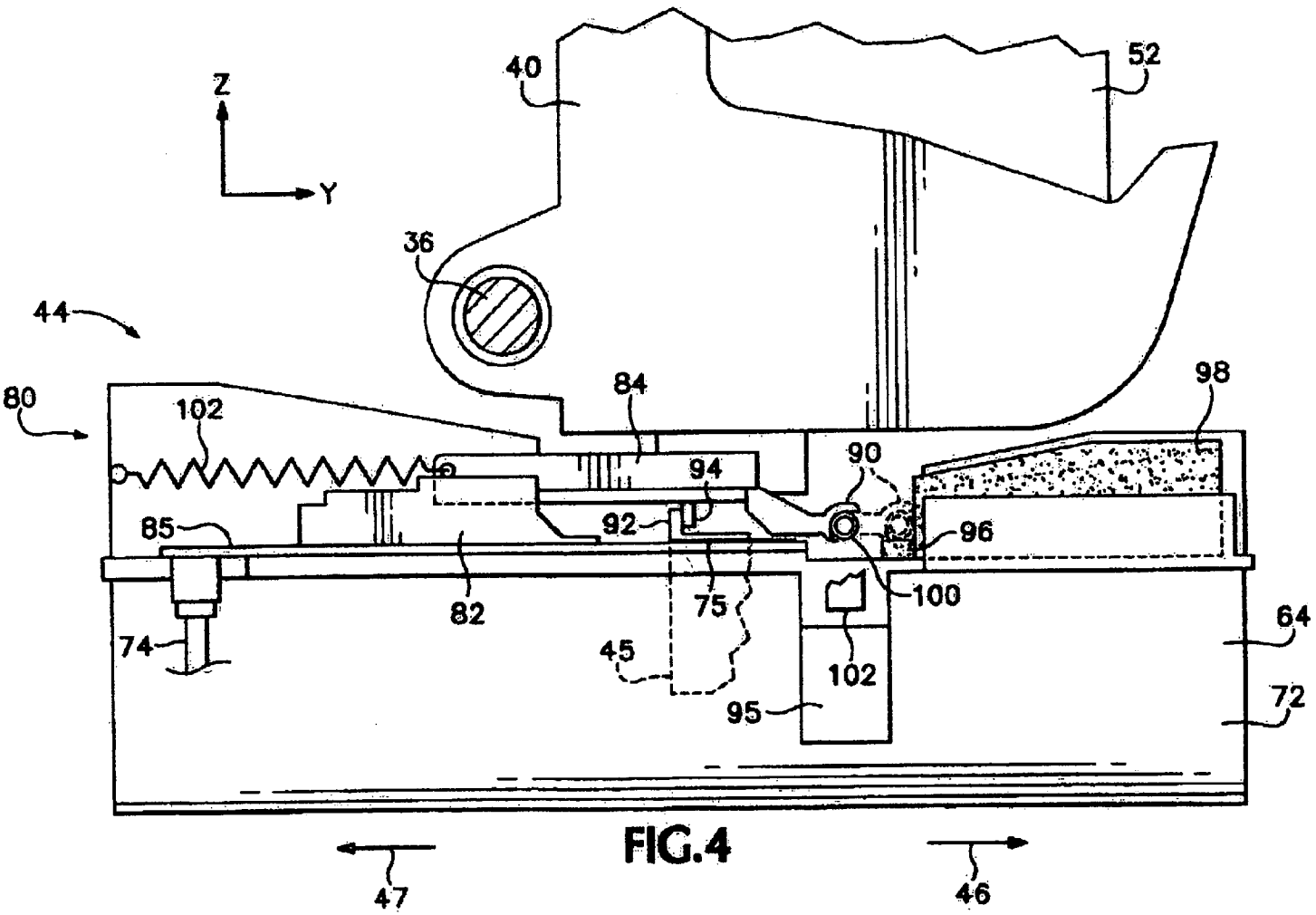

FIG. 4 showing a cleaning position.

Figure 1:
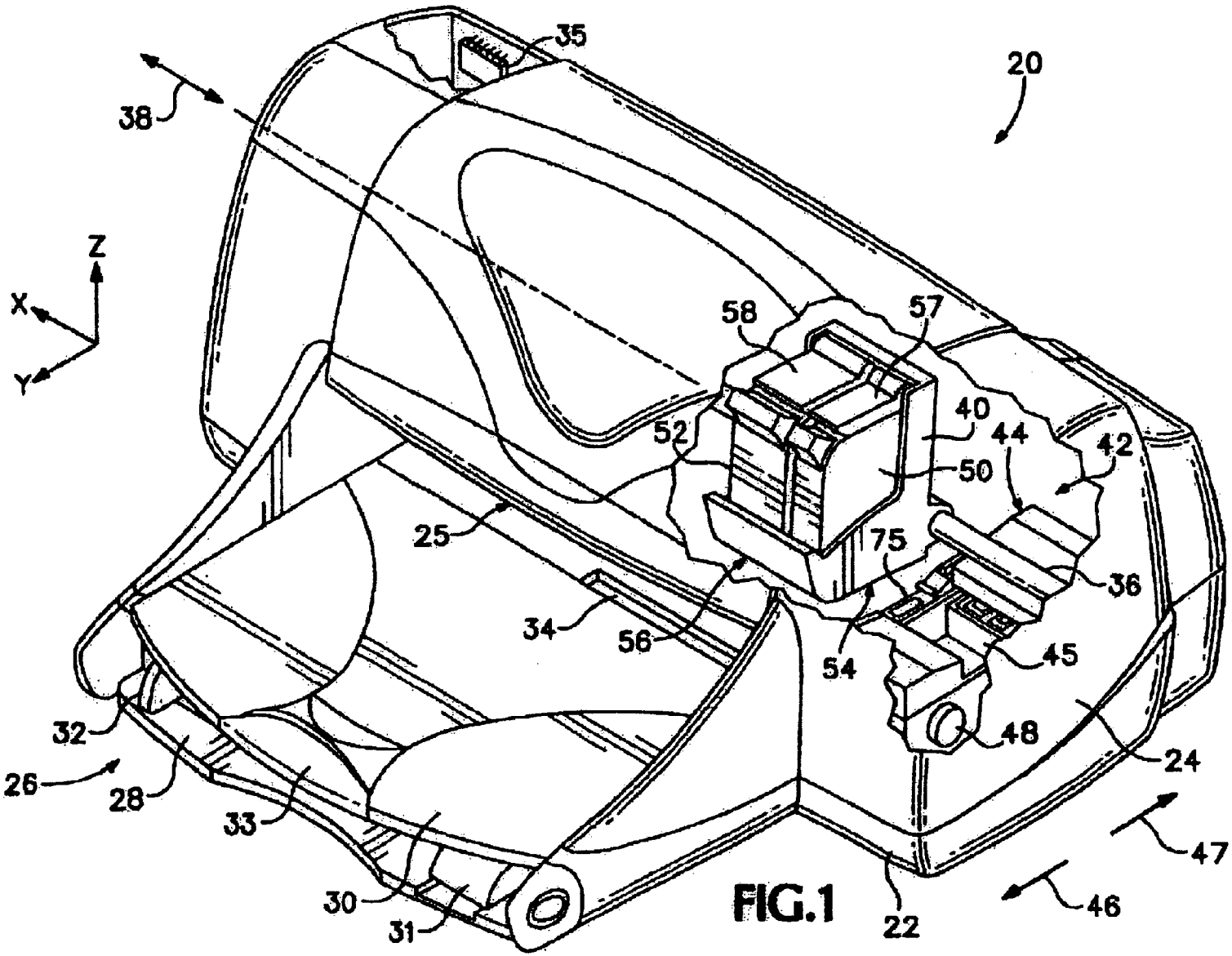
FIG. 1 is a fragmented, partially schematic, perspective view of one form of an inkjet printing mechanism including a servicing station having an electrostatic drop detector and a bulldozing cleaner system for removing ink residue left by ink droplets contacting the detector.
Figure 5:
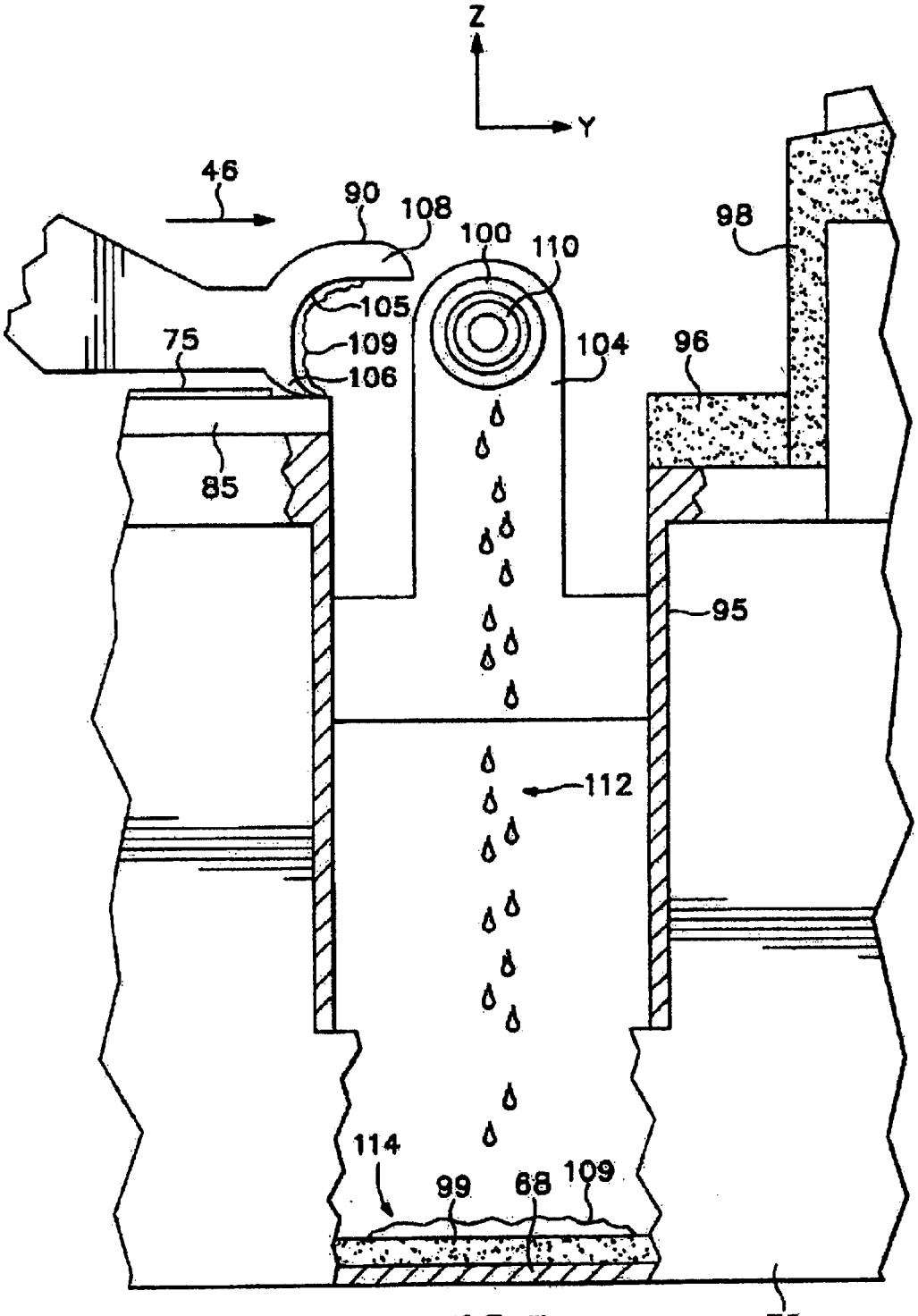

FIG. 5 is an enlarged side elevational view of one form of a scraper head for the bulldozing cleaner system of FIG. 1, including a waste ink container portion of the service station.

Figure 6:
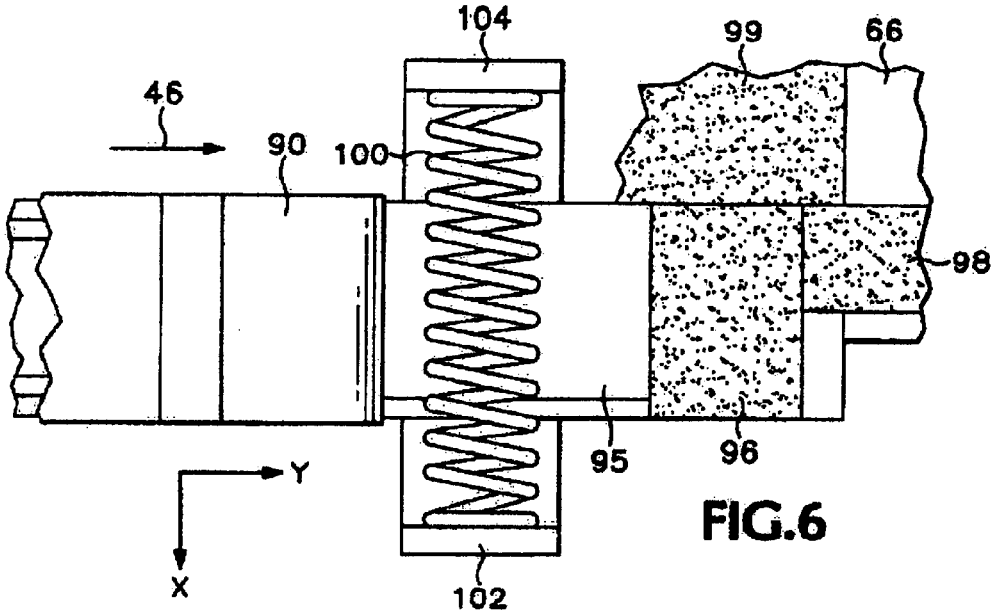

FIG. 6 is a partially fragmented, perspective view of the scraper head of FIG. 5 shown during a cleaning operation.

Figure 7:
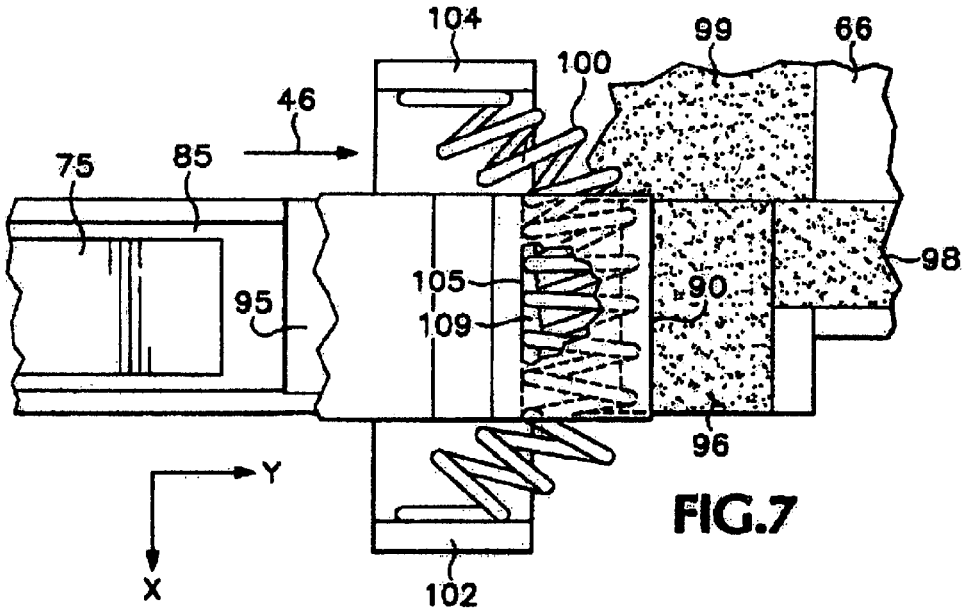

FIG. 7 is a fragmented top plan view showing another portion of the cleaning operation.

DETAILED DESCRIPTION

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 24, typically of a plastic material. Sheets of print media are fed through a printzone 25 by an adaptive print media handling system 26, constructed in accordance with the present invention. The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of conventional motor-driven paper drive rollers (not shown) may be used to move the print media from tray 28 into the printzone 25 for printing. After printing, the sheet then lands on output tray portion 30. The media handling system 26 may include a series of adjustment mechanisms for accommodating different sizes of print media, including letter, legal, A-4, envelopes, etc., such as a sliding length and width adjustment levers 31 and 32 for the input tray, a sliding length adjustment lever 33 for the output tray, and an envelope feed slot 34.

The printer 20 also has a printer controller, illustrated schematically as a microprocessor 35, that receives instructions from a host device, typically a computer, such as a personal computer (not shown). Indeed, many of the printer controller functions may be performed by the host computer, by the electronics on board the printer, or by interactions therebetween. As used herein, the term "printer controller 35" encompasses these functions, whether performed by the host computer, the printer, an intermediary device therebetween, or by a combined interaction of such elements. The printer controller 35 may also operate in response to user inputs provided through a key pad (not shown) located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 36 is mounted to the chassis 22 to define a scanning axis 38. The guide rod 36 slideably supports a reciprocating inkjet carriage 40, which travels back and forth across the printzone 25 and into a servicing region 42. One suitable type of carriage support system is shown in U.S. Pat. No. 5,366,305, assigned to Hewlett-Packard Company, the assignee of the present invention. A conventional carriage propulsion system may be used to drive carriage 40, including a position feedback system, which communicates carriage position signals to the controller 35. For instance, a carriage drive gear and DC motor assembly may be coupled to drive an endless belt secured in a conventional manner to the pen carriage 40, with the motor operating in response to control signals received from the printer controller 35. To provide carriage positional feedback information to printer controller 35, an optical encoder reader may be mounted to carriage 40 to read an encoder strip extending along the path of carriage travel.

Housed within the servicing region 42 is a service station 44. The service station 44 includes a translationally movable pallet 45, which moves forward in the direction of arrow 46, in rearwardly in the direction of arrow 47 when driven by a motor 48 operating in response to instructions received from the controller 35. While a variety of different mechanisms may be used to couple the drive motor 48 to the pallet 45, preferably a conventional reduction gear assembly drives a pinion gear which engages a rack gear formed along the undersurface of the pallet 45, for instance as shown in U.S. Pat. Nos. 5,980,018 and 6,132,026, both currently assigned to the present assignee, the Hewlett-Packard Company.

In the printzone 25, the media sheet receives ink from an inkjet cartridge, such as a black ink cartridge 50 and/or a color ink cartridge 52. The cartridges 50 and 52 are also often called "pens" by those in the art. The illustrated color pen 52 is a tri-color pen, although in some embodiments, a set of discrete monochrome pens may be used. While the color pen 52 may contain a pigment based ink, for the purposes of illustration, pen 52 is described as containing three dye based ink colors, such as cyan, yellow and magenta. The black ink pen 50 is illustrated herein as containing a pigment based ink. It is apparent that other types of inks may also be used in pens 50, 52, such as thermoplastic, wax or paraffin based inks, as well as hybrid or composite inks having both dye and pigment characteristics.

The illustrated pens 50, 52 each include reservoirs for storing a supply of ink. The pens 50, 52 have printheads 54, 56 respectively, each of which have an orifice plate with a plurality of nozzles formed therethrough in a manner well known to those skilled in the art. The illustrated printheads 54, 56 are thermal inkjet printheads, although other types of printheads may be used, such as piezoelectric printheads. Indeed, the printheads 54 and 56 may be constructed as illustrated by printhead P in the prior art drawing of FIG. 8, including nozzles N and a pair of encapsulant beads E, as described in the Introduction section above; however, it is apparent that other printheads may be constructed without encapsulant beads. These printheads 54, 56 typically include a substrate layer having a plurality of resistors which are associated with the nozzles. Upon energizing a selected resistor, a bubble of gas is formed to eject a droplet of ink from the nozzle and onto media in the printzone 25. The printhead resistors are selectively energized in response to enabling or firing command control signals, which may be delivered by a conventional multi-conductor strip (not shown) from the controller 35 to the printhead carriage 40, and through conventional interconnects between the carriage and pens 50, 52 to the printheads 54, 56.

Preferably, the outer surface of the orifice plates of printheads 54, 56 lie in a common printhead plane. This printhead plane may be used as a reference plane for establishing a desired media-to-printhead spacing, which is one important component of print quality. Furthermore, this printhead plane may also serve as a servicing reference plane, to which the various appliances of the service station 45 may be adjusted for optimum pen servicing. Proper pen servicing not only enhances print quality, but also prolongs pen life by maintaining the health of the printheads 54 and 56. To hold the pens, 50, 52 in place securely against alignment datums formed within carriage 40, preferably the carriage 40 includes black and color pen latches 57, 58 which clamp the pens 50, 52 in place as shown in FIG. 1.

Figure 2:
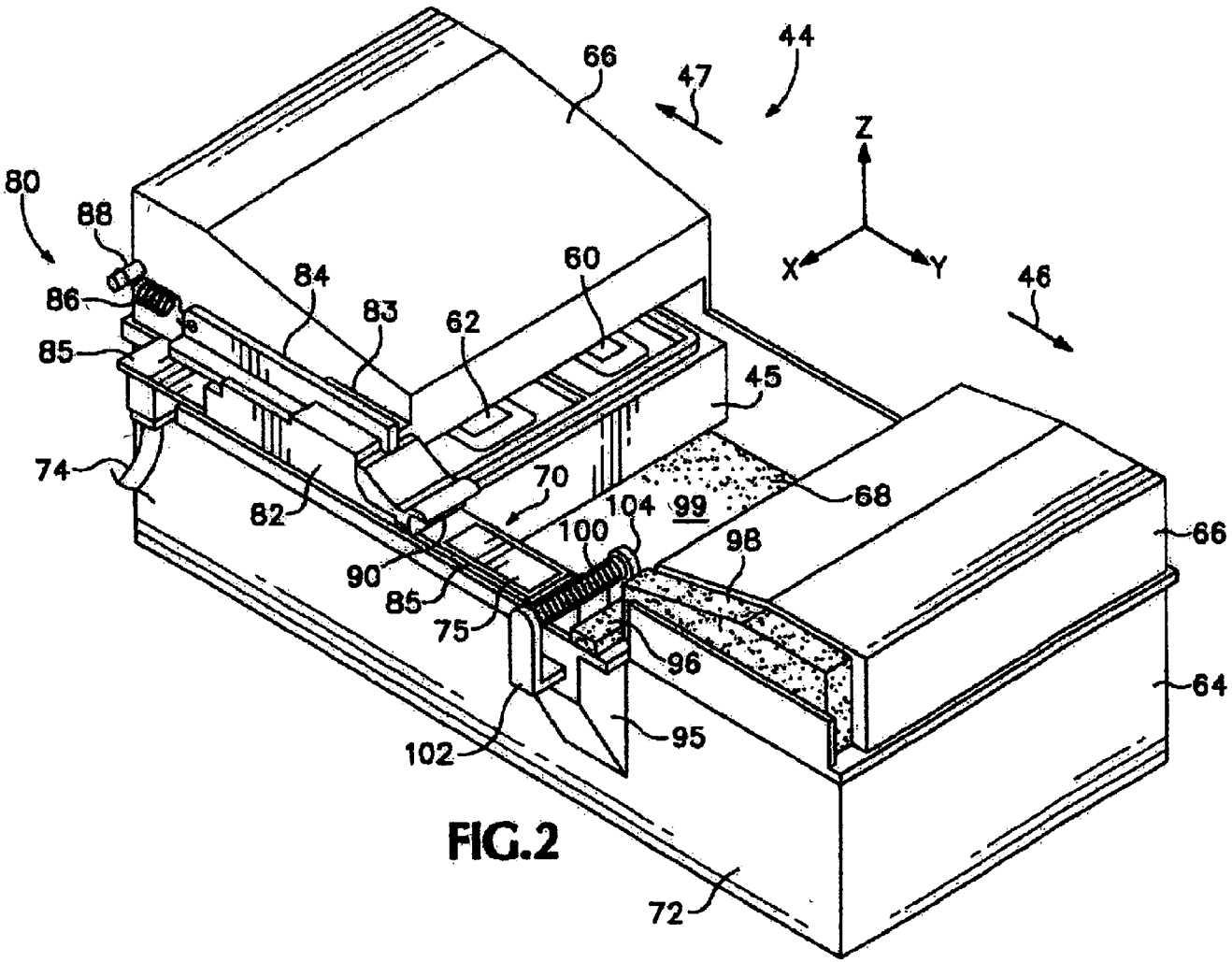
FIG. 2 is a perspective view of one form of a service station of FIG. 1.

FIG. 2 shows one form of the service station 44, constructed in accordance with the present invention. The pallet 45 may carry a variety of different servicing members for maintaining the health of the printheads 54, 56, such as printhead wipers, primers, solvent applicators, caps and the like. These various servicing members are represented in the drawing figures as black and color caps 60, 62 for sealing the printheads 54, 56 of pens 50, 52, respectively. Preferably, the pallet 45 is housed between a lower frame portion 64, and an upper frame portion 66 of the service station 44. As mentioned above, the motor 48 drives the pallet 45 in the forward and reverse directions of arrows 46 and 47 to bring the various servicing components into contact with the printheads 54, 56, preferably using a gear assembly, such as a rack and pinion gear (omitted for clarity). The frame lower portion 64 preferably defines a waste ink reservoir or spittoon 68, which receives ink purged from the printheads 54, 56 in a spitting routine. In the view of FIG. 2, the pallet 45 has been retracted to expose the spittoon 68 for a spitting operation.

The service station 44 includes an electrostatic drop detection system 70, here shown as being mounted along an inboard wall 72 of the lower frame 64. As used herein, the term "inboard" refers to items facing toward the printzone 25, and the term "outboard" refers to items facing away from printzone. The electrostatic drop detector system 70 communicates with the controller 35, such as via an electrical conductor 74 which is attached to an electronics portion (not shown) of system 70, with this electronic portion preferably being located at least in part under a spit target 75 of the system. Preferably the spit target 75 is constructed of a conductive plate which is electrically isolated from the electrical ground plane of the chassis 22, such as a plate having a conductive surface, currently gold plated, which is chemically durable with respect to the ink compositions employed, as well as having a corrosion resistance to various other environmental factors encountered by the printer 20. The spit target 75 and the associated electronics, which may be fashioned as a printed circuit assembly ("PCA"), or as an application specific integrated circuit ("ASIC"), in accordance with the teaching of U.S. Pat. No. 6,086,190 to Schantz, et al., discussed in the Introduction section above.

In the illustrated embodiment, the spit target 75 is located in line with the main spittoon 68, allowing the target 75 to receive ink droplets from printheads 54 and 56 upon entering or exiting the spittoon 68. Only when the carriage 40 is held stationary over the spittoon 68 is the pallet 45 then moved in the forward direction of arrow 46 to accomplish servicing using the various servicing members supported by pallet 45. Referring briefly to FIG. 3, we see the color printhead 56 ejecting ink droplets 76 from one nozzle 78.

The tri-color pen 52, preferably has three pairs of linear nozzle arrays, with one pair ejecting cyan ink, the second pair ejecting yellow ink, and the third pair ejecting magenta ink. In the illustrated embodiment, each color linear array contains 32 nozzles, resulting in 64 nozzles being available for dispensing each color, so that in total, the color printhead 56 has 192 nozzles. As mentioned above, the black cartridge 50 contains a pigment-based ink, whereas the color pen 52 contains dye-based inks. For the black pen 50, preferably printhead 54 has 300 nozzles, arranged in two linear arrays of 150 nozzles each. These dye-based color inks and the black pigment-based ink are relatively incompatible, and thus require separate servicing components within the service station 44. While two spit targets 75 may be used, one for the color inks and one for the black ink, preferably to minimize the overall width of printer 20, a single spit target 75 is used for both types of ink. The incompatibility of the dye-based inks and the pigment-based inks assists in preventing bleeding of the color inks into the black region and vice versa when laid down on a sheet of media, such as paper, to print a desired image. However, the incompatibility of these inks requires special cleaning of the electrostatic drop detector target 75 to allow the system 70 to function properly, and to avoid build-up of ink residue on the target to the point where it could possibly contact and damage the printheads 54, 56, in a phenomenon known as "a printhead crash."

To keep the electrostatic drop detector target 75 clean, the service station 44 includes an electrostatic drop detector cleaning system, such as a bulldozing cleaner system 80, constructed in accordance with the present invention. The illustrated cleaning system 80 includes a slider housing 82 projecting upwardly from the inboard frame wall 72, and which may include a cover portion 83 extending inboardly from the frame upper portion 66. Housed within the slider housing 82, 83 is a slider member or arm 84. In the illustrated embodiment, the slider arm 84 slides back and forth in the direction of arrows 46 and 47 over a smooth portion of a PCA circuit board 85, which carries drop detector electronics (not shown) underlying at least a portion of the drop detect target 75. The PCA board 85 preferably has electrical conductors or traces running along its undersurface, opposite the slider arm 84, to carry signals from the electronics under target 75 to the conductor 74 for communication with the controller 35.

Preferably, the slider arm 84 is biased in the rearward direction 47 by a biasing member, such as a coil spring 86 which is attached to a stationary location on the service station frame, such as post 88 projecting inboardly from the upper frame portion 66. The slider arm 84 terminates in a bulldozing scraper head 90 which traverses over target 75. To move the bulldozing head 90 from the rest position of FIGS. 2 and 3, and through a scraping stroke shown terminating in FIG. 4, preferably the pallet 45 includes an activation member, such as the upwardly projecting activation member or finger 92, which engages an activatable member or latch 94 projecting downwardly or outboardly from the slider arm 84. From the unengaged position in FIG. 3, the service station pallet 45 is driven in the forward direction 46 by motor 48 until the activation finger 92 engages latch 94 and begins pulling the slider arm 84 forward, allowing the scraper head 90 to remove ink residue from the target 75.

Preferably, the PCA board 85 terminates at the opening of a waste ink debris collection reservoir or bin 95, which may funnel ink residue removed from target 75 into the spittoon 68. The opposite side of the waste bin 95 is bounded by an absorptive deposition surface 96, which absorbs liquid ink residue cleaning to the scraper head 90. Preferably, the deposition surface 96 is fluidically coupled to a main absorber 98, so through capillary action, liquid ink residue flows from the deposition surface 96 to the main absorber body 98. In the main absorber body 98, the liquid residue eventually evaporates, leaving only solid particles from the ink compositions stored within the main absorber 98. Of course, any liquid ink residue falling into bin 95, and then into spittoon 68, may also be absorbed by an absorbent liner 99 layin along the bottom surface of the spittoon 68.

To further assist in removing ink residue from the scraper head 90, preferably a flexible, compliant, scraper head cleaner, such as a metallic coil spring 100, is suspended between two support posts 102 and 104 at or over the entrance to the debris bin 95. FIG. 5 shows an enlarged view of the scraper head 90 as having a concave interior surface defining a cavity 105, defined in part by a bottom portion of the scraper head 106, and in part by an upper hook portion of the scraper head 108. The head lower portion 106 rides along the target surface 75 and the upper surface of the PCA board 85 to scrape off ink residue 109. Preferably, the lower head portion 106 has a concave shape also, which facilitates in removing highly viscous ink accumulation from the target surface 75. This concave shape of the lower head portion 106 acts like a snow shovel, or, for those who are not familiar with colder climates, like an ice cream scoop, curling up the ink residue as it is removed from the target 75 and gathering the ink residue within the interior of the shovel cavity 105. As the ink residue 109 accumulates along the inside surface of the bulldozer cavity 105, the upper hook portion 108 of the head prevents the ink residue 109 from leaving the interior 105 of the head 90.

To remove ink residue 109 from inside the head 90, FIG. 6 shows the cleaner spring 100 received inside the scraper head cavity 105, and beginning to impact ink residue 109 therein. FIG. 5 also shows an alternate embodiment, where a second spring 110 is coiled inside the main spring 100. The secondary internal spring 110 may also be attached on each end to the support posts 102 and 104.

FIG. 7 shows that as the spring 100 is stretched, it rolls and twists, capturing the ink residue 109 between the coils of spring 100. The spring 100 is stretched and flexed as the scraper head 90 moves beyond the support posts 102, 104, allowing ink residue 109 trapped between the coils to drop from the spring into the waste bin 95. As the head 90 retracts, the spring 100 flexes again back into a neutral state between the support posts 102 and 104, with this return flexing action causing more ink residue to drop from the spring coils and land in the bin 95, as shown for residue 112 in FIG. 6. The upper hooked portion 108 of the scraper head 90 limits the ink residue from growing vertically to impact the printheads 54, 56. Moreover, the head hooked portion 108 secures the cleanout spring 100 inside cavity 105 during the cleaning action of FIGS. 6 and 7.

Any liquid ink residue clinging to the spring cleaner 100 may be captured on the absorbent deposition surface 96, where the liquids are later absorbed through capillary action into the main absorber 98. In an earlier design, it was suggested to increase the height of the deposition surface 96 to totally fill the interior of the scraper head 90, but it was believed that foam lacked enough compliance to flex, particularly after becoming coated and saturated with ink residue. It was believed that this lack of compliance of a foam absorber might have caused the service station motor 48 to stall. Furthermore, other manufacturing tolerance accumulations may not have allowed such an oversized foam deposition surface 96 to provide thorough cleaning of head 90. Thus, the spring cleaner 100, with or without the optional secondary spring 10, is presently preferred for its greater compliance, as shown in FIG. 7, where the spring cleaner flexes and yields, without causing any stalling of the service station motor 48.

The bulldozer cleaner 100 has a multitude of coils which provide voids therebetween for the ink residue 109 to enter. The residue 109 is then trapped between the spring coils as the scraper head 90 retracts, or the ink residue fall away from the spring into the bottom of the waste bin 95 then into the main spittoon 68. By varying the pitch of the coils of spring 100 and/or sprint 110, as well as the initial or "rest" tension between support posts 102 and 104, the bulldozer cleaner 100 may be adjusted to offer primarily a wicking path between adjacent coils for the liquid ink residue to enter, and/or coil surfaces which have a surface tension that attracts ink residue and sludge away from the bulldozer interior 105. Additionally, the natural deflection of the spring 100, 110 shown in FIG. 7 causes the spring to wipe the interior surface of the scraper head cavity 105. Furthermore, any ink residue which does not fall from the spring 100, 110 but instead remains attached to the coils sits on the coils and dries. Then during the next cleaning stroke, this dried ink residue clinging to the coils flakes off the coils as the spring is deflected. Thus, any dried ink clinging to the coils is not reintroduced onto the target 75 or PCA board 85 as the slider 84 retracts under the urging of the retraction spring 86.

The scraper head cleaning stroke of FIGS. 6 and 7 is a unidirectional stroke, so during retraction of the cleaned head 90 over the target 75 and the PCA board 85 no ink residue is reintroduced by the head onto these surfaces. Since all the ink residue was cleaned from the target and PCA board during the cleaning stroke, during the retraction stroke the head lower hooked portion 106 traverses smoothly over a clean surface. Additionally, use of the spring head cleaner 100, with or without the optional secondary spring 110, forms a compliant cleaning system which is economical, easy to assemble, and robust enough to last the lifetime of printer 20. Use of the secondary spring 110 advantageously provides additional wicking paths between the coils of spring 110 to trap liquid ink residue, and the flexing of the internal spring 110 against the main spring 100 assists in cleaning ink residue from the interior of spring 100 during the deflection of FIG. 7. To avoid having the coils of spring 110 get trapped between the coils of spring 100, these springs may be oriented with their twists going in opposite directions.

While the concepts of the bulldozing cleaner system 80 for removing ink residue 109 from the inkjet electrostatic drop detector 70 have been described with respect to two embodiments, one with a single spring 100 and one with multiple springs 100 and 110, it is apparent that these concepts may be employed in a variety of equivalent manners, depending upon the particular implementations employed, while still falling within the scope of the claims below. For example, the multiple spring embodiment may not only have one spring embedded inside the other, instead the springs may be arranged side-by-side or on top of each other.

As another example, while in the illustrated embodiment the target 75 is held in a fixed position and the scraper head 90 moves over the target, in some implementations it may be preferred to have the scraper head 90 remain in a fixed position, and the electrostatic drop detector target 75 move, or both the scraper head and target may move. Relative motion between the target 75 and scraper 90 cleans the target; relative motion between the scraper 90 and the cleaner spring 100, 110 cleans the scraper; and flexion of the cleaner 100 cleans the scraper cavity 105, as well as the cleaner. For instance, the target 75 may carry a latch member similar to latch 94 to be activated by motion of the pallet finger 92, with the target advancing out to a drop detecting position as shown in FIG. 2, and then withdrawing under a stationarily mounted scraper head 90. During this withdrawal stroke, if the cleaning spring 100, 110 were mounted at the front end (positive Y-axis direction) of the target, the head would be cleaned during this withdrawal process, leaving a clean target stored in a retracted position underneath the slider arm 84. In such an implementation, the waste bin 95 may be relocated to a more rearward position to collect debris from the head as the target is withdrawn under the scraper head and the spring 100 is also withdrawn into engagement with the scraper head 90.

Additionally, while coil springs 100, 110 are illustrated, in some implementations it may be desirable to stretch other flexible compliant members like an elastomeric member, such as a group of rubber band-like members, between the support posts 102 and 104, either instead of or in addition to the springs 100, 110; however the illustrated metallic coil springs are preferred for their durability. Furthermore, other enhancements may be made to the head cleaner, such as to weave bristles between the spring coils, providing additional cleaning surfaces for removing residue 109 from the head interior 105. Such variations and modifications of the concepts described herein fall within the scope of the claims below.

We claim:

1. A cleaning system for cleaning ink residue from a sensor in a printing mechanism which deposits ink on the sensor, comprising:

a scraper member having a head which, through relative motion of the head and sensor, gathers ink residue from the sensor; and a flexible member having plural cleaning segments positioned along an elongate axis of the flexible member which, through relative motion and engagement of the flexible member and head, flexes normal to its elongate axis and collects ink residue from the head with the cleaning segments.

2. A cleaning system according to claim 1 wherein:

the flexible member has two opposing ends which are stationarily supported along said elongate axis, with a middle section between the two opposing ends which flexes normal to the elongate axis; and the head moves while the flexible member remains stationarily supported at said opposing ends.

3. A cleaning system according to claim 2 wherein:

the head the defines a cavity therein which contains the gathered ink residue; and the middle section of the flexible member enters the head cavity during said engagement.

4. A cleaning system according to claim 1 further including a waste ink collection bin, wherein flexion of the flexible member normal to said elongate axis dislodges ink residue from the cleaning segments, and the collection bin is located under the flexible member when flexing from engagement with the head to capture the dislodged ink residue.

5. A cleaning system according to claim 1 wherein the flexible member comprises a spring having multiple coils forming the plural cleaning segments.

6. A cleaning system according to claim 1 wherein the flexible member comprises first and second springs.

7. A cleaning system according to claim 6 wherein:

the first spring comprises a coil spring defining an interior space; and the second spring comprises a coil spring located in the interior space of the first spring.

8. A cleaning system according to claim 7 wherein:

the first spring has a spiral twist in a first direction; and the second spring has a spiral twist in a second direction opposite the first direction.

9. A cleaning system according to claim 1 further including an absorbent member which contacts the cleaning segments and absorbs liquid portions of the ink residue therefrom.

10. A cleaning system according to claim 9 wherein the absorbent member comprises:

a contacting member which contacts the cleaning segments; and a storage member which is in fluidic communication with the contacting member to receive said liquid portions from the contacting member.

11. A cleaning system according to claim 1 wherein the head comprises:

a first member which contacts the sensor while gathering said ink residue; and a second member, with the first and second member together defining a cavity which collects the gathered ink residue.

12. A cleaning system according to claim 11 wherein the second member of the head overhangs the sensor and confines the gathered ink residue thereunder.

13. A cleaning system according to claim 1 wherein said sensor comprises an electrostatic drop detector which detects the presence of ink deposited thereon.

14. An inkjet printing mechanism, comprising:

an inkjet printhead which selectively ejects ink therefrom;

a sensor located to receive ink from the printhead, leaving an accumulation of ink residue on the sensor; and a sensor cleaning system comprising:

a scraper member having a head which, through relative motion of the head and sensor, gathers ink residue from the sensor; and a flexible member having plural cleaning segments which, through relative motion and engagement of the flexible member and head perpendicular to one another, flexes and collects ink residue from the head with the cleaning segments.

15. An inkjet printing mechanism according to claim 14 wherein:

the head moves while the sensor remains stationary;

the flexible member has two opposing ends which are stationarily supported along an elongate axis of the flexible member, with a middle section between the two opposing ends which flexes perpendicular to the elongate axis;

the head moves while the flexible member remains stationary;

the head the defines a cavity therein which contains the gathered ink residue; and the middle section of the flexible member enters the head cavity during said engagement.

16. An inkjet printing mechanism according to claim 14 further including:

a waste ink collection bin, wherein flexion of the flexible member dislodges ink residue from the cleaning segments, and the collection bin is located under the flexible member when flexing from engagement with the head to capture the dislodged ink residue.

17. An inkjet printing mechanism according to claim 14 wherein the flexible member comprises a spring having multiple coils forming the plural cleaning segments.

18. An inkjet printing mechanism according to claim 14 wherein:

the flexible member comprises first and second springs;

the first spring comprises a coil spring defining an interior space; and the second spring comprises a coil spring located in the interior space of the first spring.

19. An inkjet printing mechanism according to claim 14 further including an absorbent member having a contacting member and a storage member, with the contacting member contacting the cleaning segments and absorbing liquid portions of the ink residue therefrom, and wherein the storage member is in fluidic communication with the contacting member to receive said liquid portions from the contacting member.

20. A method of cleaning ink residue from a sensor in a printing mechanism, comprising:

accumulating ink residue on the sensor;

scraping the ink residue from the sensor with a scraper member having a head which gathers ink residue from the sensor;

providing a flexible member having plural cleaning segments positioned along an elongate axis;

providing relative movement of the head normal to said elongate axis so as to cause flexing of said flexible member normal to said elongate axis; and while flexing, collecting ink residue from the head with the cleaning segments.

21. A method according to claim 20 wherein:

said scraping comprises gathering the scraped ink residue inside a cavity defined by the head; and said collecting comprises collecting the gathered ink residue from the cavity.

22. A method according to claim 20 wherein said flexing comprises stretching the flexible member.

23. A method according to claim 20 wherein the flexible member comprises a coil spring having plural coils forming said cleaning segments, with said collecting comprising trapping the ink residue between said coils.

24. A method according to claim 20 wherein the flexible member comprises first and second springs, and the method further includes rubbing the first and second springs together to remove ink residue collected thereon.

25. A method according to claim 20 further comprising removing ink residue from the cleaning segments while flexing.

26. A method according to claim 25 further comprising depositing ink residue removed from the cleaning segments into a waste ink receptacle.

27. A method according to claim 20 further comprising absorbing liquid components of the ink residue from the cleaning segments.

* * * * *

UNITED STATES PATENT AND TRADEMARK OFFICE

CERTIFICATE OF CORRECTION

PATENT NO. : 6,761,429 B2
DATED : July 13, 2004
INVENTOR(S) : Su et al.

It is certified that error appears in the above-identified patent and that said Letters Patent is hereby corrected as shown below:

Column 9,
Line 32, after “head”, delete “the” and insert therefor -- that --.

Column 10,
Line 38, after “head”, delete “the” and insert therefor -- that --.

Signed and Sealed this

Tenth Day of May, 2005

JON W. DUDAS
*Director of the United States Patent and Trademark Office*